US006461131B2

(12) United States Patent
Chang

(10) Patent No.: US 6,461,131 B2
(45) Date of Patent: Oct. 8, 2002

(54) RADIAL COMPLIANCE SCROLL COMPRESSOR

(75) Inventor: Yong Il Chang, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/828,135

(22) Filed: Apr. 9, 2001

(65) Prior Publication Data

US 2002/0001532 A1 Jan. 3, 2002

(30) Foreign Application Priority Data

Jun. 30, 2000 (KR) ..... 2000-37223

(51) Int. Cl.[7] ..... F04C 18/00
(52) U.S. Cl. ..... 418/55.5; 418/57
(58) Field of Search ..... 418/55.5, 57

(56) References Cited

U.S. PATENT DOCUMENTS 5,378,129 A * 1/1995 Dunaevsky et al. ..... 418/55.5
5,496,158 A * 3/1996 Barito et al. ..... 418/55.5
5,520,527 A * 5/1996 Kim ..... 418/55.5
6,146,119 A * 11/2000 Bush et al. ..... 418/55.5

FOREIGN PATENT DOCUMENTS

JP 2000-73970 * 3/2000 ..... 418/55.5

* cited by examiner

*Primary Examiner*—Thomas Denion
*Assistant Examiner*—Theresa Trieu

(74) *Attorney, Agent, or Firm*—Birch, Stewart, Kolasch & Birch, LLP

(57) ABSTRACT

A radial compliance scroll compressor is provided where two scrolls having involute wraps are engaged with each other, the orbiting scroll of the two scrolls having a boss portion eccentrically coupled to a driving pin portion formed on the front end surface of a crank shaft undergoes an orbital motion to thus form a plurality of compression chambers whose positions are continually moved between the two wraps, and the orbiting scroll coupled to the crank shaft goes backward in a radial direction within a predetermined range to thus isolate the wraps of the two scrolls from each other and then return to the normal state, thereby forming a compression chamber, which is characterized in that: an eccentric bush is inserted between the outer circumferential surface of the driving pin portion of the crank shaft and the inner circumferential surface of the boss portion of the orbiting scroll coupled thereto to be rotatably and eccentrically coupled to the crank shaft; a stopper pin restricting the radius movement of the eccentric bush is inserted between one side portion of the outer circumferential surface of the driving pin portion and the opposing inner circumferentical surface of the eccentric bush; and a stopper latch surface closely attached to the outer circumferential surface of the stopper pin and restricting the radius movement of the eccentric bush along with the orbiting scroll within a predetermined range. Accordingly, the area of a bearing surface between the crank shaft and the main frame supporting the same in the radius direction, whereby the friction loss occurred to the bearing surface is reduced, and the production cost for the crank shaft is also reduced.

4 Claims, 7 Drawing Sheets

RADIAL COMPLIANCE SCROLL COMPRESSOR

BACKGROUND OF THE INVENTION

1. Field of the Invention

The present invention relates to a radial compliance scroll compressor, and more particularly, to a radial compliance scroll compressor for minimizing friction loss and leakage loss between wraps of an orbiting scroll and a fixed scroll.

2. Description of the Background Art

Conventionally, a compressor converts a mechanical energy into a compression energy of compressible fluid, and it is classified into a reciprocating type, scroll-type, centrifugal-type(generally, turbo-type), and vane-type (generally, rotary-type). Among them, unlike the reciprocating-type compressor using a piston, the scroll-type compressor has a structure in which gas is sucked, compressed, and discharged by using a rotating body as the centrifugal-type and vane-type.

Such a scroll-type compressor is divided into a fixed radius scroll compressor which is configured such that an orbiting scroll orbits around the same radius all the time regardless of changes in compressing conditions, and a radial compliance scroll compressor which is configured such that the orbiting scroll goes backward in a radial direction, and then returns to the original status in order to prevent wraps from being damaged when liquid refrigerant, oil, or impurities are flowed into a compression chamber to thus abnormally increase pressure in the compression chamber.

To vary the orbital radius of the orbiting scroll in this radial compliance scroll compressor, the methods of inserting a slide bush or slide block, or an eccentric bush between the crank shaft and the orbiting scroll are commonly known. Among them, the present invention relates to a radial compliance scroll compressor for intervening an eccentric bush.

As illustrated in FIG. 1, such a radial compliance scroll compressor is configured such that: a main frame 2 and a sub frame 3 are fixed at both upper and lower sides of the inner circumferential surface of a casing 1 filled with oil at an adequate height; a driving motor 4 having a stator 4A and a rotor 4B is fixedly installed between the main frame 2 and the sub frame 3; a crank shaft 5 is forcibly inserted into the center of the rotor 4B of the driving motor 4 through the main frame 2; an orbiting scroll 6 having an involute wrap 6*a* and being eccentrically coupled to the crank shaft 5 is orbitably installed on the upper portion of the main frame 2; a fixed scroll 7 having an involute wrap 7*a* engaged with the wrap 6*a* of the orbiting scroll 6 to form a plurality of compression chambers is fixedly installed at the periphery portion of the main frame 2 on the upper surface of the orbiting scroll 6; and a discharge cover 8 dividing the interior of the casing 1 into a discharge pressure area, i.e., a high pressure portion, and a suction pressure area, i.e., a low pressure portion, is fixed to the inner circumferential surface of the casing 1 at the upper side of the fixed scroll 7.

At the front end surface of the crank shaft 5, a driving pin portion 5*a* for eccentrically rotating the orbiting scroll 6 is eccentrically protruded, and an oil passage 5*b* slantingly extends through the center of the driving pin portion 5*a* to the lower end of the crank shaft 5.

As illustrated therein FIG. 2, an eccentric bush 9 inserted into a boss portion 6*b* of the orbiting scroll 6 for thereby retreating the orbiting scroll 6 in a radius direction upon abnormal compression is eccentrically inserted into the driving pin portion 5*a,* and a stopper pin 10 for restricting the rotational movement of the eccentric bush 9 is inserted into the eccentric bush 9 so that it has a predetermined radial movable range.

More specifically, the upper half portion of the stopper pin 10 is inserted into to the eccentric bush 9, and the lower half portion thereof is movably inserted into a stopper groove 5*d* provided at the front end surface 5*c* of the crank shaft 5.

In the drawings, unexplained reference numeral 2*a* designates a through hole forming a radial bearing surface of the crank shaft 5.

The thusly configured scroll compressor in the conventional art will be operated as follows.

That is to say, the rotor 4B orbits the orbiting scroll 6 while being rotated together with the crank shaft 5 in the interior of the stator 4A by an applied power. At the same time, the orbiting scroll 6 undergoes an orbiting motion at a distance of the orbital radius from the pivot of the shaft by an Oldham ring(not shown) to thus form a plurality of compression chambers between the two wraps 6*a* and 7*a*. The volume of the compression chamber is reduced as the compression chambers move toward the center by a continual orbital motion of the orbiting scroll 6, resulting in discharging of sucked gaseous refrigerant.

At this time, in the case that the gaseous refrigerant flowed into the compression chamber remains in a normal state, the wrap 6*a* of the orbiting scroll 6 and the wrap 7*a* of the fixed scroll 7 contact with each other to thus form a closed space in the compression chambers at both sides, thereby making the eccentric bush 9 and the stopper pin 10 keep their position as shown in FIG. 4A. On the contrary, in the case that the gaseous refrigerant flowed into the compression chambers contains more than a predetermined amount of liquid refrigerant, oil, or other impurities as described above□□, the pressure of the compression chamber is abnormally increased to make the orbiting scroll 6 tend to go backward. This tendency of going backward is delivered to the eccentric bush 9 inserted into the boss portion(shown in FIG. 2) 6*b* of the orbiting scroll 6. This eccentric bush 9 is rotated in the counterclockwise direction (the direction in which the orbiting scroll goes backward) until it reaches the stop position of the stopper pin as shown in FIG. 4B, and the wrap 6*a* of the orbiting scroll and the wrap 7*a* of the fixed scroll are isolated from each other. At this time, compression gas in a high pressure compression chamber(HR) is leaked into a low pressure compression chamber(LR), and then the wrap 6*a* of the orbiting scroll is restored to the original state, thus preventing the damage to the wraps 6*a* and 7*a* due to an However, in the conventional scroll compressor as described above, since the stopper pin 10 is provided at a predetermined interval from the driving pin portion 5*a,* the diameter(D1) of the crank shaft 5 must be formed larger than the gap between the stopper pin 10 and the driving pin portion 5*a* as illustrated in FIG. 3. In addition, the diameter of the through hole 2*a* of the main frame 2 supporting thcrank shaft in a radius direction also become larger for thereby increasing the frictional area between the crank shaft 5 and the main frame 2. Therefore, there occurs a problem that the motor efficiency is degraded due to friction loss during driving of the compressor as well as the material cost is increased.

SUMMARY OF THE INVENTION

Accordingly, it is an object of the present invention to provide a radial compliance scroll compressor capable of minimizing friction loss between a main frame and a bearing surface by decreasing the diameter of a crank shaft.

To achieve the above object, there is provided a radial compliance scroll compressor according to the present invention, where two scrolls having involute wraps are engaged with each other, the orbiting scroll of the two scrolls having a boss portion eccentrically coupled to a driving pin portion formed on the front end surface of a crank shaft undergoes an orbiting motion to thus form a plurality of compression chambers whose positions are continually moved between the two wraps, and the orbiting scroll coupled to the crank shaft goes backward in a radial direction within a predetermined range to thus isolate the wraps of the two scrolls from each other and then return to the normal state, thereby forming a compression chamber, which is characterized in that: an eccentric bush is inserted between the outer circumferential surface of the driving pin portion of the crank shaft and the inner circumferential surface of the boss portion of the orbiting scroll coupled thereto to be rotatably and eccentrically coupled to the crank shaft; a stopper pin restricting the radius movement of the eccentric bush is inserted between one side portion of the outer circumferential surface of the driving pin portion and the opposing inner circumferentical surface of the eccentric bush; and a stopper latch surface closely attached to the outer circumferential surface of the stopper pin and restricting the rotational movement of the eccentric bush and thusly the radius backward movement of the eccentric bush along with the orbiting scroll within a predetermined range.

In addition, in the radial compliance scroll compressor according to the present invention, it is preferred that the stopper latch surface of the driving pin portion is formed in a D-cut shape so that the stopper pin is slidably and linearly latched thereto in the backward direction.

In addition, in the radial compliance scroll compressor according to the present invention, it is preferred that an elastic member for elastically supporting the scrolls whose eccentric bush undergoes orbiting motion all the time is provided between the stopper latch surface and the corresponding stopper pin.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

The preferred embodiment of the present invention will now be described with reference to the accompanying drawings.

Figure 1:
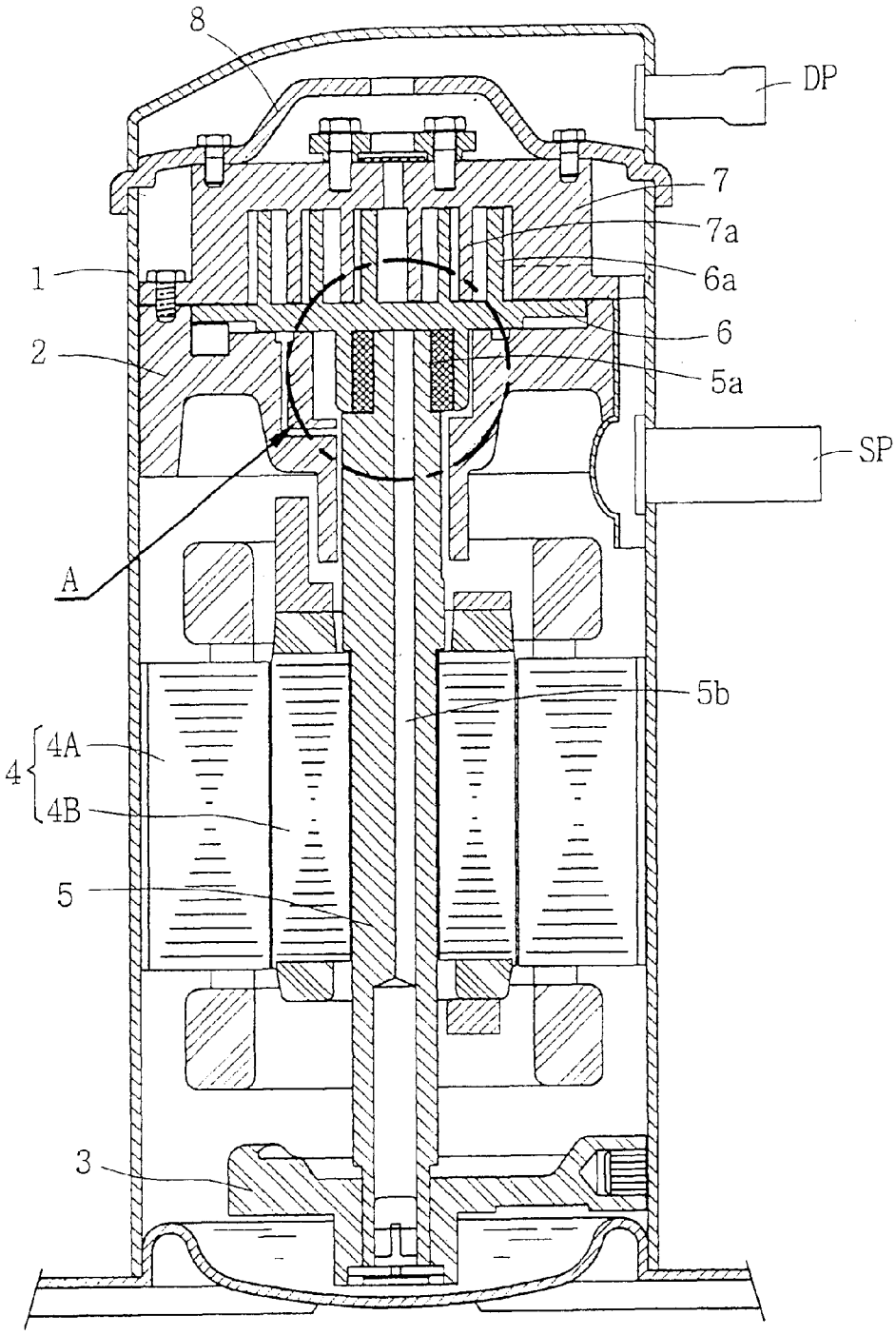
FIG. 1 BACKGROUND ART
FIG. 1 is a vertical cross-sectional view illustrating one example of a conventional scroll compressor.
Figure 2:
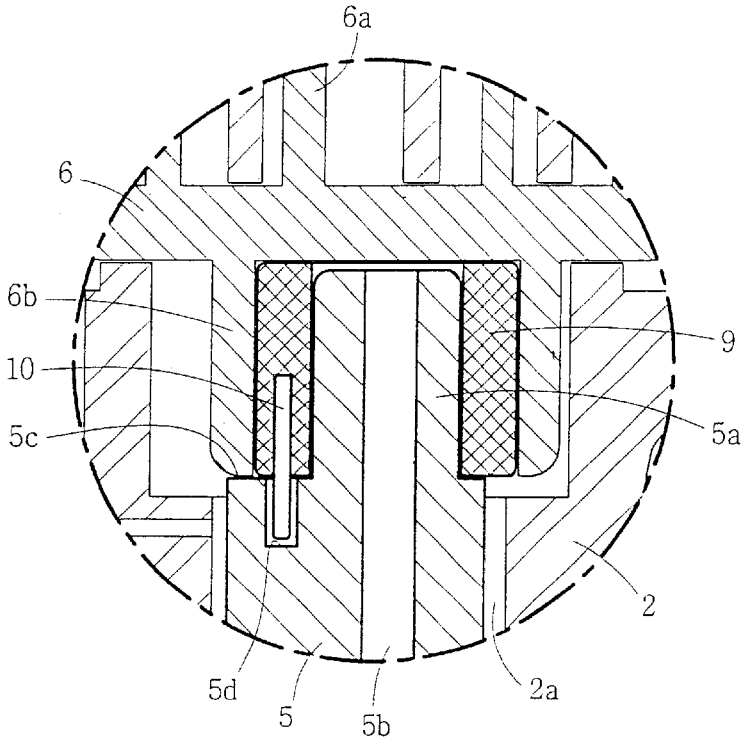
FIG. 2 BACKGROUND ART
FIG. 2 is a vertical cross-sectional view illustrating "A" part of FIG. 1 in detail.
Figure 3:
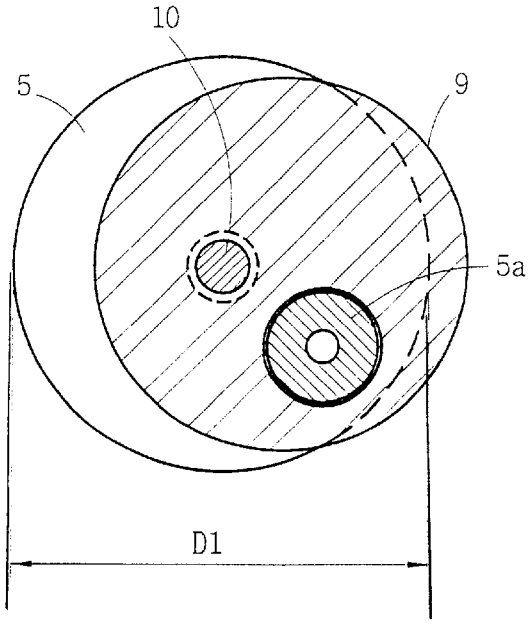
FIG. 3 BACKGROUND ART
FIG. 3 is a cross-sectional view illustrating the coupled state of an eccentric bush in the conventional scroll compressor.
Figure 4A:
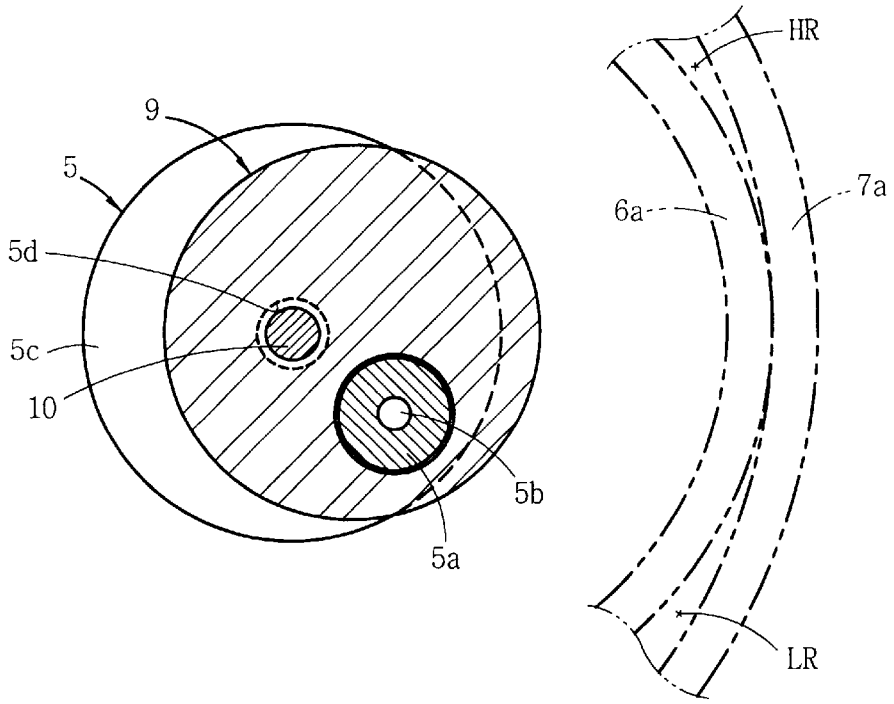
FIG. 4A BACKGROUND ART
FIGS. 4A and 4B are cross-sectional views illustrating the motion of the eccentric bush according to a driving state in the conventional scroll compressor.
Figure 4B:
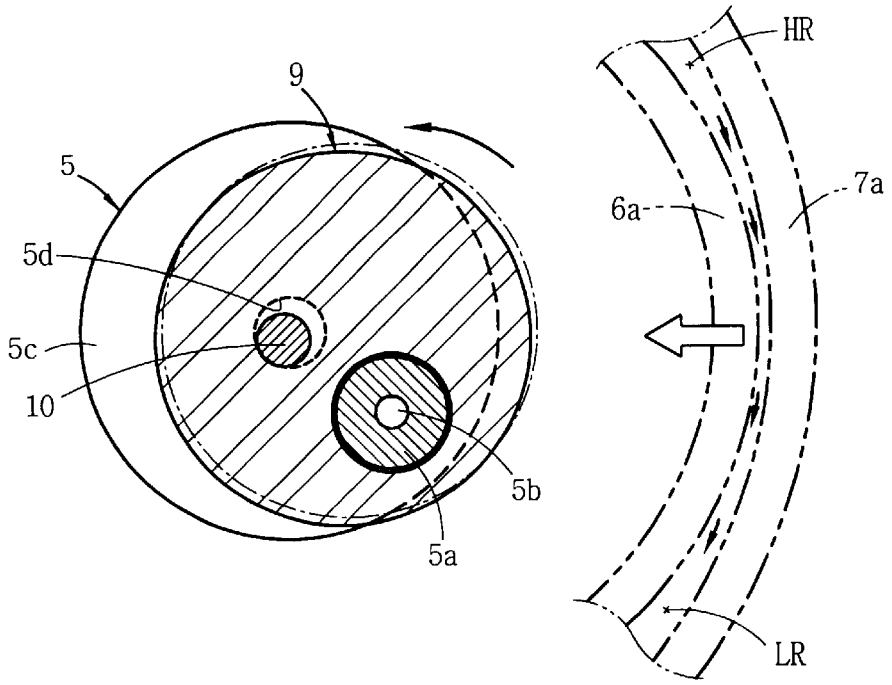
FIG. 4B BACKGROUND ART
Figure 5:
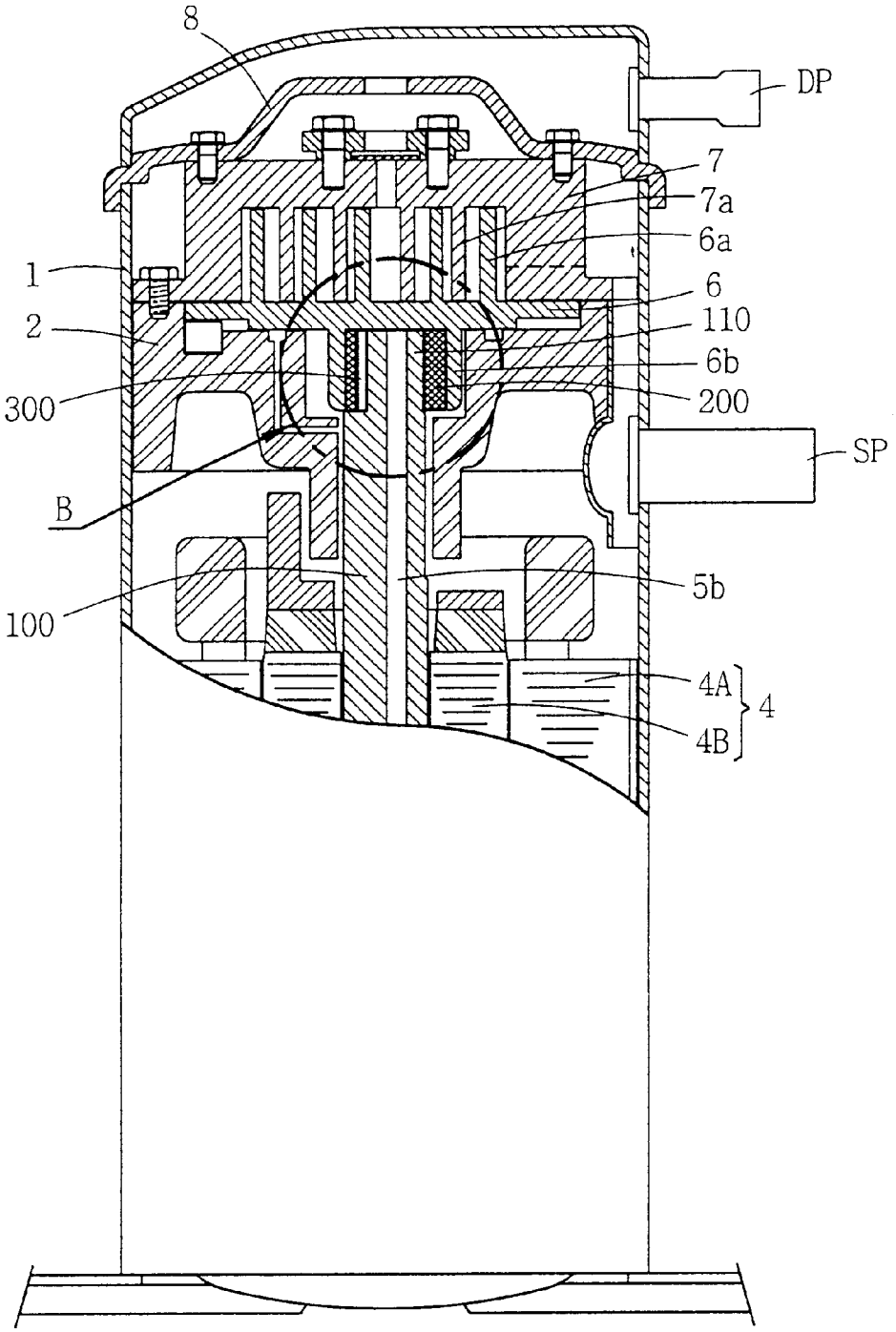
FIG. 5 is a vertical cross sectional view illustrating parts of a radial compliance scroll compressor according to the present invention.
Figure 6:
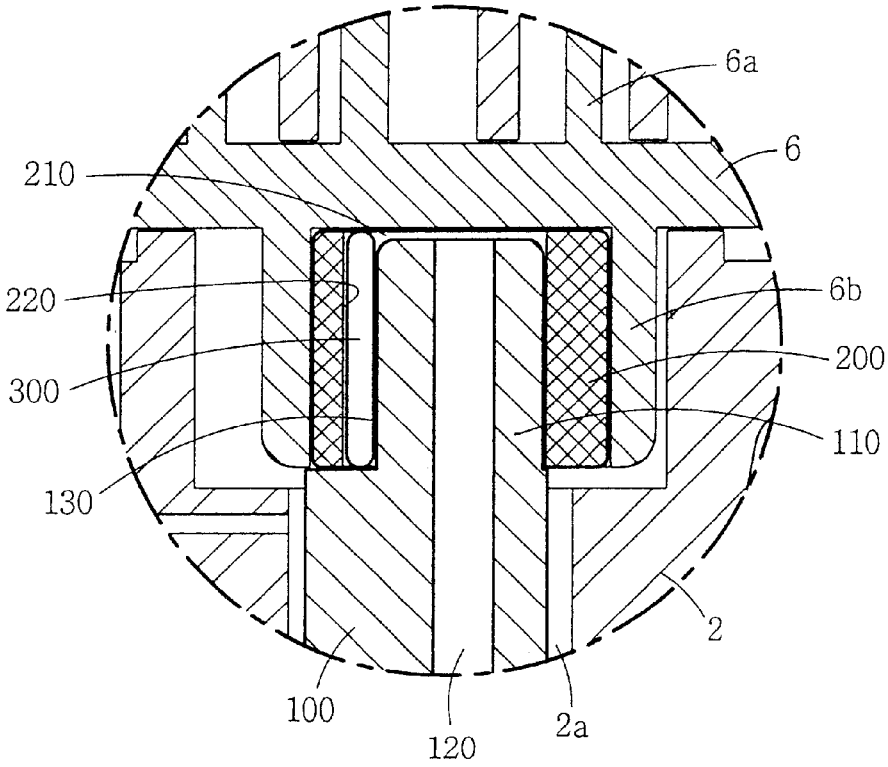
FIG. 6 is a vertical cross-sectional view illustrating "B" part of FIG. 5 in detail.
Figure 7:
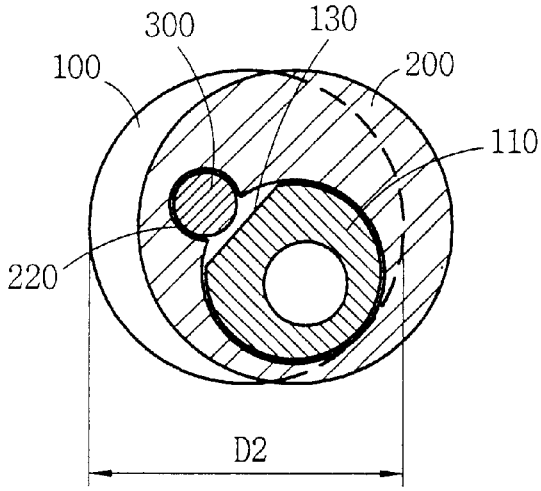
FIG. 7 is a cross-sectional view illustrating the coupled state of an eccentric bush in the radial compliance scroll compressor according to the present invention.
Figure 8A:
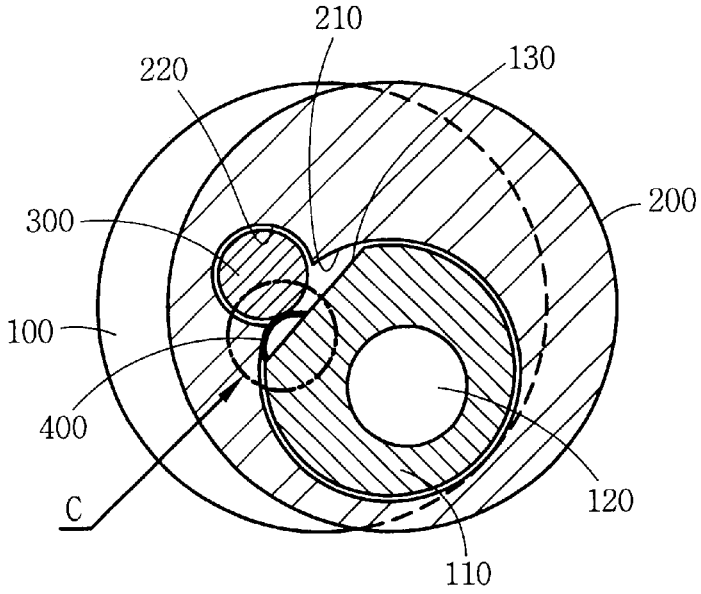
FIG. 8A is a cross-sectional view illustrating the coupled state of the eccentric bush to which an elastic member is added in the radial compliance scroll compressor according to the present invention.
Figure 8B:
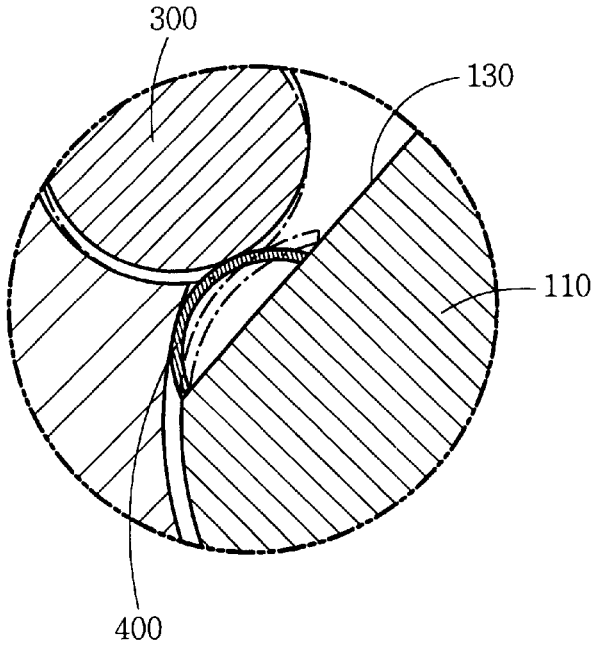
FIG. 8B is a detailed view illustrating part "C" of FIG. 8A.
Figure 9A:
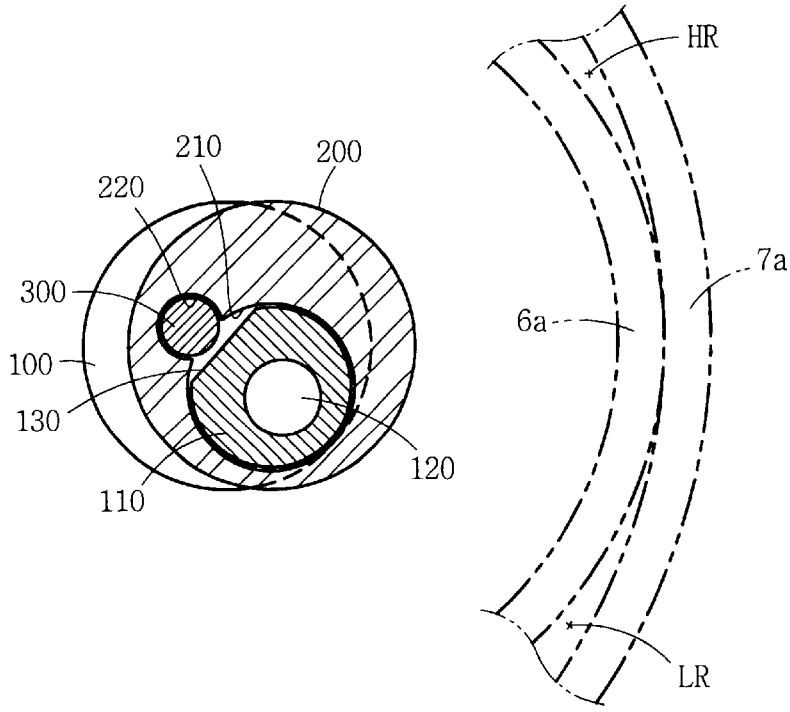
FIGS. 9A and 9B are cross-sectional views illustrating the motion of the eccentric bush according to a driving state of the radial compliance scroll compressor according to the present invention.
Figure 9B:
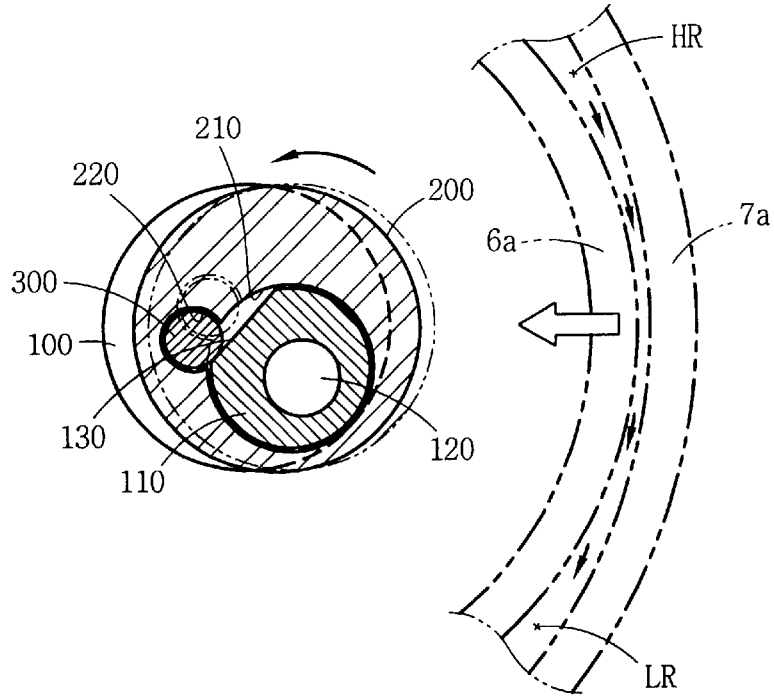

FIG. 5 is a vertical cross sectional view illustrating parts of a radial compliance scroll compressor according to the present invention. FIG. 6 is a vertical cross-sectional view illustrating "B" part of FIG. 5 in detail. FIG. 7 is a cross-sectional view illustrating the coupled state of an eccentric bush in the radial compliance scroll compressor according to the present invention. FIGS. 8A and 8B are a cross-sectional view illustrating the coupled state of the eccentric bush to which an elastic member is added in the radial compliance scroll compressor according to the present invention. FIGS. 9A and 9B are cross-sectional views illustrating the motion of the eccentric bush according to a driving state of the radial compliance scroll compressor according to the present invention.

As illustrated therein, the radial compliance scroll compressor according to the present invention includes: a main frame 2 and sub frame(not shown) fixed at both upper and lower sides of a casing 1 having a suction pipe(SP) and a discharge pipe(DP); a driving motor 4 mounted in the casing 1 between the main frame 2 and the sub frame; a crank shaft 100 coupled to a rotor 4B of the driving motor 4 via the main frame 2 and the sub frame; an orbiting scroll 6 having an involute wrap 6*a* and eccentrically coupled to the upper end of the crank shaft 100; a fixed scroll 7 having an involute wrap 7*a* which is engaged with the wrap 6*a* of the orbiting scroll 6 to thus form a plurality of compression chambers and fixedly coupled to the main frame 2 at the upper side of the orbiting scroll 6; and an eccentric bush 200 which is eccentrically coupled to the upper end of the crank shaft 100 to thus rotate the orbiting scroll slidably and eccentrically according to the pressure of the compression chamber.

The crank shaft 100 is supported via a through hole 2*a* of the main frame 2 and sub frame. A driving pin portion 110 eccentrically rotating the orbiting scroll is eccentrically formed on the upper end surface of the crank shaft 100. The center of the driving pin 110 is preferably disposed away from the pivot of the crank shaft 100 as far as possible.

A boss portion 6*b* into which the driving pin portion 110 of the crank shaft 100 is inserted is formed on the bottom of the orbiting scroll 6, and an orbiting bush(not shown) is insertingly coupled to the inner circumferential surface of the boss portion 6*b*.

As illustrated in FIG. 6, an eccentric bush 200 eccentrically rotating the orbiting scroll 6 and retreating the orbiting scroll 6 in a radius direction in the case that the pressure of the compression chamber is excessively increased is rotatably and eccentrically coupled to the driving pin portion 110 of the crank shaft 100.

The eccentric bush 200 has almost the same diameter as the crank shaft 100. A driving pin coupling hole 210 into which the driving pin portion 110 of the crank shaft 100 is inserted in slidable contact is formed at the eccentric bush 200. A stopper coupling hole 220 for allowing the driving pin coupling hole 210 to accept parts of the cylindrical surface of a stopper pin 300 is formed at the eccentric bush 200.

The stopper pin 300 for restricting the degree of rotational movement of the eccentric bush 200 and thusly the radius backward movement of the eccentric bush 200 along with the orbiting scroll 6 within a predetermined range is axially inserted in the stopper coupling hole 220.

The stopper pin 300 is coupled between the crank shaft 100 and the eccentric bush 200 and arranged to contact to the driving pin portion 110 of the crank shaft 100. At the outer circumferential surface of the driving pin potion 110, as illustrated in FIG. 7, a stopper latch surface 130 is formed in a D-cut shape at an angle of stagger in the backward direction of the orbiting scroll so that the stopper pin 300 is latched thereto.

As illustrated in FIGS. 8A and 8B, it is preferred that a plate elastic member 400 pushing the eccentric bush 200 is inserted on the stopper latch surface 130 in order to prevent the wrap 6*a* of the orbiting scroll 6 from being isolated from the wrap 7*a* of the fixed scroll 7 while the eccentric bush 200 drags and rotates an orbiting bush(not shown) and the orbiting scroll 6 by means of the viscosity of oil during a normal operation or starting operation.

In the drawings, the same elements are denoted by the same reference numerals.

The general operation of the radial compliance scroll compressor according to the present invention is similar to that of the conventional scroll compressor.

That is, when a power is applied to the driving motor 4 to thus rotate the crank shaft 100, the orbiting scroll 6 eccentrically coupled to the crank shaft 100 orbits around a predetermined radius. In a series of processes in which the volume of the compression chamber is reduced while the compression chamber formed between the wrap 6*a* of the orbiting scroll 6 and the wrap 7*a* of the fixed scroll 7 continuously moves to the pivot of the orbiting motion, gaseous refrigerant is sucked into the compression chamber, and gradually compressed and discharged.

Here, in the case that gaseous refrigerant flowed into the compression chamber remains in a normal state, the wrap 6*a* of the orbiting scroll 6 and the wrap 7*a* of the fixed scroll 7 are in a line contact with each other, and thus the compression chambers at both sides forms a closed space. Thus, as illustrated in FIG. 9A, the eccentric bush 200 and the stopper pin 300 keep their positions at a predetermined interval from each other.

On the other hand, in the case that the gaseous refrigerant flowed into the compression chamber contains a predetermined amount of liquid refrigerant, oil, or other impurities, the pressure of the compression chamber is abnormally increased, and thus the orbiting scroll 6 tends to go backward in a radius direction by the pressure of the compression chamber. This tendency of going backward is delivered to the eccentric bush 200 inserted into the boss portion 6*b* of the orbiting scroll 6. This eccentric bush 200 is rotated in the counterclockwise direction together with the stopper pin 300 as illustrated in FIG. 9B. When the stopper pin 300 is latched to a D-cut surface of the stopper latch surface 130 provided at the driving pin portion 110 of the crank shaft 100 while being rotated within a limited range, further rotation of the eccentric bush 200 is restricted to thereby stop the radius backward movement of the eccentric bush 200 and the orbiting scroll 6.

At this time, the wrap 6*a* of the orbiting scroll 6 is isolated from the wrap 7*a* of the fixed scroll as far as the eccentric bush 200 goes backward in the radius direction together with the orbiting scroll 6. Resultantly, compression gas moves from a high pressure compression chamber(HR) to a low pressure compression chamber(LR) as the compression chambers are opened. Then, the wrap 6*a* of the orbiting scroll 6 is restored to the original state for thereby preventing excessive compression of the compression chamber.

In this way, when the stopper pin 300 is arranged within the range of direct contact to the driving pin portion 110 of the crank shaft 100, the diameter D2 of the crank shaft 100 to the sectional area of the same eccentric bush 200 as in FIG. 7 is remarkably reduced. Thus, the area of the bearing surface between the outer circumferential surface of the crank shaft 100 and the corresponding inner circumferential surface of the through hole of the main frame 2 is decreased, and resultantly the friction loss generated on this bearing surface is minimally reduced. In addition, as the diameter D2 of the crank shaft 100 becomes smaller, the material cost required for the crank shaft also can be reduced.

Meanwhile, though not illustrated in the drawings, the stopper pin can be insertingly coupled to the outer circumferential surface of the driving pin portion. In this case, it is preferred that a stopper insertion groove is formed on the upper end of the driving pin portion, and the stopper latch surface formed at the inner circumferential surface of the eccentric bush is formed in a D-cut shape at an angle of stagger in the backward direction of the orbiting scroll, so that the stopper pin that is slightly isolated upon the normal operation of the compressor, and then goes backward in a radius direction while being rotated together with the eccentric bush upon an abnormal operation such as an excessive compression operation, is latched to the inner circumferential surface of one side of the stopper insertion groove. In this case, since the diameter of the crank shaft can be made smaller as compared to the above-described example, the resultant operational effects such as decrease in friction loss and decrease in production cost can be increased two times.

As described above, the radius adaptive structure of the scroll compressor according to the present invention is constructed such that an eccentric bush is inserted between the outer circumferential surface of the driving pin portion of the crank shaft and the inner circumferential surface of the boss portion of a scroll coupled thereto to thus be rotatably and eccentrically coupled to the crank shaft, a stopper pin restricting the rotational movement of the eccentric bush is inserted between the front end surface of the crank shaft and the corresponding surface of one side of the eccentric bush, and a stopper latch surface attached to the outer circumferential surface of the stopper pin for restricting the rotational movement of the eccentric bush and thusly the radius backward movement of the eccentric bush along with the orbiting scroll within a predetermined range is formed at an angle of stagger upon a plane projection in the backward direction of the scroll for thereby arranging the stopper pin in contact with the driving pin portion of the crank shaft. Therefore, as the diameter of the crank shaft is reduced, the area of a bearing surface between the crank shaft and the main frame supporting the same is reduced. By this, the friction loss occurred to the bearing surface is reduced, and the production cost for the crank shaft is also reduced.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalences of such metes and bounds are therefore intended to be embraced by the appended claims.

What is claimed is:

1. A radial compliance scroll compressor, where two scrolls having involute wraps are engaged with each other, the orbiting scroll of the two scrolls having a boss portion eccentrically coupled to a driving pin portion formed on the upper end portion of a crank shaft undergoes an orbital motion to thus form a plurality of compression chambers whose positions are continually moved between the two wraps, and the orbiting scroll coupled to the crank shaft goes backward in a radial direction within a predetermined range to thus isolate the wraps of the two scrolls from each other and then return to the normal state, thereby forming a compression chamber, which is characterized in that:

an eccentric bush is inserted between the outer circumferential surface of the driving pin portion of the crank shaft and the inner circumferential surface of the boss portion of the orbiting scroll coupled thereto to be rotatably and eccentrically coupled to the crank shaft, and has a stopper coupling hole which is formed at the inner circumferential surface thereof;

a stopper pin restricting the radius movement of the eccentric bush is inserted in the stopper coupling hole; and a stopper latch surface is formed at the outer circumferential surface of the driving pin portion, and in contact with the outer circumferential surface of the stopper pin so as to restrict the rotational movement of the eccentric bush and thus allowing the radius backward movement of the eccentric bush along with the orbiting scroll within a predetermined range.

2. The radial compliance scroll compressor according to claim 1, wherein the stopper latch surface of the driving pin portion is formed in a D-cut shape so that the stopper pin is slidably and linearly latched thereto in the backward direction.

3. The radial compliance scroll compressor according to claim 2, wherein an elastic member for elastically supporting the scrolls whose eccentric bush undergoes orbiting motion all the time is provided between the stopper latch surface and the corresponding stopper pin.

4. A radial compliance scroll compressor, where two scrolls having involute wraps are engaged with each other, the orbiting scroll of the two scrolls having a boss portion eccentrically coupled to a driving pin portion formed on the front end surface of a crank shaft undergoes an orbital motion to thus form a plurality of compression chambers whose positions are continually moved between the two wraps, and the orbiting scroll coupled to the crank shaft goes backward in a radial direction within a predetermined range to thus isolate the wraps of the two scrolls from each other and then return to the normal state, thereby forming a compression chamber, which is characterized in that:

an eccentric bush is inserted between the outer circumferential surface of the driving pin portion of the crank shaft and the inner circumferential surface of the boss portion of the orbiting scroll coupled thereto to be rotatably and eccentrically coupled to the crank shaft;

a stopper pin restricting the radius movement of the eccentric bush is inserted between one side portion of the outer circumferential surface of the driving pin portion and the opposing inner circumferential surface of the eccentric bush; and a stopper latch surface closely attached to the outer circumferential surface of the stopper pin and restricting the radius movement of the eccentric bush along with the orbiting scroll within a predetermined range, wherein the stopper latch surface of the driving pin portion is formed in a D-cut shape so that the stopper pin is slidably and linearly latched thereto in the backward direction, and wherein an elastic member for elastically supporting the scrolls whose eccentric bush undergoes orbiting motion all the time is provided between the stopper latch surface and the corresponding stopper pin.

* * * * *